United States Patent [19]

Gruber et al.

[11] 4,451,837

[45] May 29, 1984

[54] CONDUCTIVE SINGLE COMPONENT MAGNETIC TONER FOR USE IN ELECTRONIC PRINTING DEVICES

[75] Inventors: Robert J. Gruber, Pittsford; John F. Knapp, Fairport, both of N.Y.

[73] Assignee: Xerox Corporation, Stamford, Conn.

[21] Appl. No.: 383,662

[22] Filed: Jun. 1, 1982

Related U.S. Application Data

[63] Continuation-in-part of Ser. No. 188,487, Sep. 18, 1980, abandoned.

[30] Foreign Application Priority Data

Sep. 17, 1981 [ES] Spain ..... 505.586
Sep. 18, 1981 [GB] United Kingdom ..... 8128306

[51] Int. Cl.[3] ..... G03G 13/00
[52] U.S. Cl. ..... 346/153.1; 430/106.6
[58] Field of Search ..... 430/110, 107, 106.6; 346/153.1

[56] References Cited

U.S. PATENT DOCUMENTS

| | | | |
|---|---|---|---|
| 2,846,333 | 8/1958 | Wilson | 117/17.5 |
| 3,196,032 | 7/1965 | Seymour | 430/137 |
| 3,590,000 | 6/1971 | Palermiti et al. | 430/106.6 X |
| 3,627,682 | 12/1971 | Hall, Jr. | 252/62.54 |
| 3,639,245 | 2/1972 | Nelson | 430/106.6 |
| 3,787,877 | 1/1974 | Nacci et al. | 346/74 MT |
| 4,031,021 | 6/1977 | Deming . | |
| 4,108,786 | 8/1978 | Takayama et al. . | |
| 4,145,300 | 3/1979 | Hendriks . | |
| 4,146,494 | 3/1979 | Hectors et al. . | |
| 4,220,698 | 9/1980 | Brynko et al. | 430/106.6 |
| 4,271,248 | 6/1981 | Gaudioso | 430/39 |
| 4,288,516 | 9/1981 | Gaudioso | 430/107 |
| 4,353,080 | 10/1982 | Cross | 346/153.1 |

FOREIGN PATENT DOCUMENTS

| | | |
|---|---|---|
| 2606998 | 9/1976 | Fed. Rep. of Germany . |
| 2225963 | 12/1977 | Fed. Rep. of Germany . |

*Primary Examiner*—John D. Welsh
*Attorney, Agent, or Firm*—E. O. Palazzo

[57] ABSTRACT

An improved conductive single component magnetic dry toner composition for use in developing images in electronic printing systems of a conductivity of from $10^{-6}$ to $10^{-8}$ (ohms/cm)$^{-1}$, and a fusing temperature of from about 95 degrees Centigrade to about 130 degrees Centigrade, and comprised of a magnetic material present in an amount of from about 40 percent by weight to about 80 percent by weight, and from about 20 percent by weight to about 60 percent by weight of a polyester resin, comprised of the polymeric esterification product of a dicarboxylic acid and a diol comprising a diphenol of the formula:

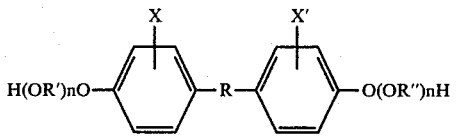

wherein R is selected from substituted and unsubstituted alkylene radicals containing from about 2 to about 12 carbon atoms, alkylidene radicals containing from 1 to about 12 carbon atoms, and cycloclkylidene radicals containing from about 3 to about 12 carbon atoms; R' and R'' are selected from substituted and unsubstituted alkylene radicals containing from about 2 to about 12 carbon atoms, alkylene arylene radicals containing from about 8 to about 12 carbon atoms and arylene radicals; X and X' are selected from hydrogen or alkyl radicals containing from 1 to about 4 carbon atoms; and each n is a number of from 0 (zero) to 4, a conductive carbon black present in an amount of from about 0.5 percent to about 4 percent, which carbon black is adhered to or embedded in the surface of the polyester magnetic mixture.

3 Claims, No Drawings

CONDUCTIVE SINGLE COMPONENT MAGNETIC TONER FOR USE IN ELECTRONIC PRINTING DEVICES

BACKGROUND OF THE INVENTION

This application is a continuation-in-part of copending application U.S. Ser. No. 188,487, filed Sept. 18, 1980, abandoned.

This invention relates generally to single component toner compositions; and more specifically, the present invention is directed to single component conductive toner compositions which are useful for producing high quality images in electronic printing machines. The improved single component toner compositions of the present invention which are comprised of a mixture of certain ingredients, as specified hereinafter, have a conductivity in the range of $10^{-6}$ to $10^{-8}$ (ohm/cm)$^{-1}$. These compositions are thus very useful in electronic printing machines, such as the commercially available Versatec printers. Also embraced within the scope of the present invention are processes for developing images formed in electronic printing machines utilizing the specific single component dry toner compositions disclosed.

While the toner compositions of the present invention have been found to be highly useful for developing images in electronic printing machines, such compositions may also be useful for the development of xerographic latent images. The development of latent images with two component developer compositions containing toner particles and carrier particles is well known. In one such system magnetically managable carrier particles are selected, and there is applied to the developer composition a magnetic force for the purpose of causing adherence of the carrier and toner particles to a support member, which is presented to the image bearing member. One advantage of magnetic brush development, in comparison to cascade development, is that magnetic development provides better solid area coverage, is very well compacted, and does not depend on gravity to present the toner particles to the latent image bearing surface.

Additionally, there are known single component developer compositions, that is those that do not contain carrier particles, one such composition being disclosed in U.S. Pat. No. 2,864,333. In this patent there is described the use of a magnetic brush system to apply toner particles formed of ferrites and a resin material to an image bearing member, wherein the image contained thereon is developed. One difficulty encountered with this process is that the conductivity of the resulting toner particles renders electrostatic transfer difficult. However, these processes have been used commercially when special papers are employed, such as coated papers like zinc oxide.

There is also disclosed in U.S. Pat. No. 3,909,258 an electrostatic development magnetic brush process wherein a single component toner composition is selected. A toner suitable for use in this process is described in U.S. Pat. No. 3,639,245, wherein there is disclosed a dry toner powder having a specific electronic conductivity. More specifically the toner disclosed is comprised of a thermo plastic composition of a conductivity of at most, $10^{-12}$ ohm/cm, in which are essentially completely embedded, electrically conductive particles having a conductivity of at least $10^{-2}$ ohm/cm, the resulting toner particles having a conductivity ranging monatomically without decreasing of from between $10^{-11}$ and $10^{-4}$ ohm/cm at a 100 volt/cm DC electrical field, to between about $10^{-8}$ and $10^{-3}$ ohm/cm, at a 10,000 volt/cm DC electrical field. This toner is prepared by blending magnetite with toner resin particles, and subsequently pulverizing the resulting material to a small particle size. The resulting particles are then mixed with carbon black, and small particle size silicon dioxide particles. One disadvantage of the toner of the '245 patent is that it does not usually transfer well in electrostatic systems.

In another process for achieving the development of electrostatic charge patterns, there is employed a conductive one component toner composition which is contained on a conductive support member, and brought into contact with the charge pattern bearing member, as described in U.S. Pat. No. 3,166,432. In this situation the toner particles are held to the support member by Vanderwaals forces, and the conductive support member is held at a bias potential during development. This technique is particularly adaptable to solid area coverage, and further requires only one component in the development material, no separate carrier particles being present.

There is also known a method of developing electrostatic charge patterns using an electroscopic toner particles suspended in a liquid system. With the proper choice of materials, the toner particles become charged to a definite polarity which is dispersed in the liquid. When the electrostatic charge pattern bearing member is brought into contact with the liquid toner suspension, the toner particles deposit where there is a preponderence of charge of the opposite polarity, as in cascade development.

Systems are also known where liquid developer materials are selected as a substitute for dry materials. Liquid developer materials main disadvantage is that a solvent must be employed as part of the developer mixture, which solvent evaporates from the machine environment, emitting undesirable odors, and causing potential toxicity problems. In electrography, liquid ink techniques are utilized to develop electrostatic images produced by air ionization, from writing nibs on dielectric coated paper.

Accordingly, there continues to be a need for single component toner compositions useful in electronic printing systems, which compositions can be fused at relatively low fusing temperatures. Additionally, there continues to be a need for toner compositions of a specific conductivity, which have adequate flow properties, thus rendering these compositions highly useful for developing images in electronic printing machine systems.

SUMMARY OF THE INVENTION

It is an object of the present invention to provide single component dry toner compositions which are very useful in electronic printing systems.

A further object of the present invention is the provision of single component conductive dry magnetic toners which possess excellent flow properties, and have a low melt fusing temperature in the range of from about 95° C. to about 130° C.

It is a further object of the present invention to provide conductive single component dry toner compositions of a conductivity in the range of from $10^{-6}$ to $10^{-8}$ (ohm/cm)$^{-1}$, containing a magnetic material, and embedded therein a conductive substance.

These and other objects of the present invention are accomplished by providing a conductive single component dry toner composition for causing the development of images in electronic printing devices, which composition has a conductivity of from $10^{-6}$ to $10^{-8}$ (ohm/cm)$^{-1}$, and a fusing temperature of from about 95° C. to about 130° C., this composition being comprised of a magnetic material present in an amount of from about 40 percent to about 80 percent by weight, a conductive carbon black present in an amount of from about 0.5 percent to about 4 percent, which carbon black is adhered to or embedded in the surface of the polyester magnetic mixture, and from about 20 percent by weight to about 60 percent by weight of a polyester resin, comprised of the polymeric esterification product of a dicarboxylic acid and a diol comprising a diphenol of the formula:

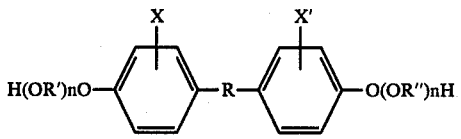

wherein R is selected from substituted and unsubstituted alkylene groups containing from about 2 to about 12 carbon atoms, alkylidene groups containing from about 1 to about 12 carbon atoms, and cycloakylidene groups containing from about 3 to about 12 carbon atoms; R' and R'' are selected from substituted and unsubstituted alkylene groups containing from about 2 to about 12 carbon atoms, alkylene arylene groups containing from about 8 to about 12 carbon atoms and arylene groups; X and X' are selected from hydrogen or alkyl groups containing from 1 to about 4 carbon atoms; and each n is a number of from 0 (zero) to 4.

Diphenols wherein R represents an alkylidene radical having from 2 to 4 carbon atoms and R' and R'' represents an alkylene radical having from 3 to 4 carbon atoms are preferred since greater blocking resistance, increased definition of xerographic characters and more complete transfer of the toner images are achieved. Optimum results are obtained with diols in which R is a isopropylidene radical and R' and R'' are selected from the group consisting of propylene and butylene radicals, and n is 1 (one), as the resins formed from these diols possess higher agglomeration resistance, and penetrate extremely rapidly into paper receiving sheets.

Typical diphenols having the foregoing general structure include: 2,2-bis(4-beta hydroxy ethoxy phenyl)-propane, 2,2-bis(4-hydroxy isopropoxy phenyl)-propane, 2,2-bis(4-beta hydroxy ethoxy phenyl)pentane, 2,2-bis(4-beta hydroxy ethoxy phenyl)-butane, 2,2-bis(4-hydroxy-propoxy-phenyl)propane, 2,2-bis(4-hydroxy-propoxy-phenyl)propane, 1,1-bis(4-hydroxyethoxy-phenyl)butane, 1,1-bis(4-hydroxy isopropoxy-phenyl)-heptane, 2,2-bis(3-methyl-4beta-hydroxy ethoxy-phenyl)propane, 1,1-bis(4-beta hydroxy ethoxy phenyl)-cyclohexane, 2,2'-bis(4-beta hydroxy ethoxy phenyl)-norbornane, 2,2'-bis(4 beta hydroxy ethoxy phenyl)norbornane, 2,2-bis(4-beta hydroxy styryl oxyphenyl)propane, the polyoxy-ethylene ether of isopropylidene diphenol in which both phenolic hydroxyl groups are oxyethylated, and the average number of oxyethylene groups per mole is 2.6, the polyoxypropylene ether of 2-butylidene diphenol, in which both the phenolic hydroxyl groups are oxyalkylated, and the average number of oxypropylene groups per mole is 2.5; and the like.

Various suitable dicarboxylic acids may be reacted with the above diols described above to form the toner resins of this invention, which acids may be substituted, unsubstituted, saturated or unsaturated, including the anhydrides of such acids. Typical acids and anhydrides include: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydrides, fumaric acid, phthalic acid anhydride, traumatic acid, citraconic acid, and the like. Dicarboxylic acids having from 3 to 5 carbon atoms are preferred because the resulting toner resins containing same possess greater resistance to film formation on reusable imaging surfaces, and resists the formation of fines under machine operation conditions. Optimum results are obtained with alpha unsaturated dicarboxylic acids such as fumaric acid, maleic acid, or maleic acid anhydride, as maximum resistance to physical degradation of the toner compositions, and rapid melting properties are achieved. Although it is not entirely clear, it is believed that the presence of the unsaturated bonds in the alpha unsaturated dicarboxylic acid reactants provides the resin molecules with a greater degree of toughness, without adversely affecting the fusing and comminution characteristics.

The preferred polyester resin material of the present invention results from the reaction of 2,2-bis(4-hydroxy isopropoxy phenyl)propane and fumaric acid.

The polyester resin is present in an amount of from about 20 percent to about 60 percent, and preferably from about 45 percent to about 55 percent. The main function of the polyester resin is to impart its low melting properties to the resulting toner, thus, allowing the toner composition to fix at low temperatures of from about 90° C. to about 130° C., and preferably from about 90° C. to about 110° C.

The magnetic pigment mixed with the polyester resin to form the toner composition of the present invention can be comprised of numerous suitable particles, which will produce the desired magnetic properties, including materials such as ferrites, iron particles, nickel alloys, and preferably magnetites such as Mapico black a mixture of iron oxides, a commercially available material, MO-4232, a magnetite commercially available from Pfizer Pigment Co., New York, N.Y., and K-378, a magnetite commercially available from Northern Pigments Corporation, Toronto, Ontario Canada. Mapico black is preferred in that the particles are black in color, of low cost and provide excellent magnetic properties. The amount of magnetic pigment present ranges from about 40 weight percent to about 80 weight percent, and preferably from about 45 weight percent to about 55 weight percent.

The toner compositions of the present invention are magnetic in nature, in that they are attached to a magnet but are not magnets themselves. Such toners can be held to a magnetic brush roller or belt by magnetic forces. The development field between the electrically connected magnetic brush and the receptor surface, induces a charge into the toner particles, opposite to the charge on the receptor and subsequently the particles develop the electrostatic image.

One important feature of the composition of the present invention is the presence of a conductive carbon on the surface of the toner particles comprised of the resin indicated, and the magnetic material. The carbon black is adhered, and/or embedded into the surface of the toner particles, subsequent to the blending of the magnetic material with the resin. By embedding the carbon black into the toner resin particles excellent conductive toners are obtained, which toners also have superior flow properties. Also embedding by heat spheroidization causes a slight rounding of the toner particles, thereby allowing them to flow more easily.

It is only by adhereing and/or embedding the carbon black particles into the toner particles that excellent print quality and free powder flow is obtained. By embedding is meant that the carbon black particles are firmly attached to the surface of the toner particles. Thus, such particles do not dust, that is, freely migrate throughout the imaging device, or print out. It is also critical that the carbon black utilized be embedded on the surface of the toner particles in such a manner so as to provide the appropriate conductivity, as indicated herein to the toner particles. One method used for accomplishing this is by known heat spheroidization processes, for example as described in U.S. Pat. No. 3,639,245.

Suitable conductive carbon blacks that can be selected for use include Regal 330, Vulcan black, and the like. Vulcan carbon black which is preferred, is commercially available from Cities Service Company.

The conductive carbon black is present in an amount of from about 0.5 percent to about 4 percent. Preferably about 2 percent, of conductive carbon black is utilized.

The toners of the present invention generally have a resistivity that is dependent on the strength of the electric field, however, such toners are sufficiently conductive at typical development fields. Thus the toner compositions of the present invention possess a powder resistivity of at least $10^6$ to $10^{10}$ ohms-cm. This resistivity allows excellent development, in electrographic Versatec printing systems, where no electrostatic transfer is needed. As the resistivity is equal to the reciprocal of the conductivity, the conductivity of the toner composition of the present invention is from $10^{-6}$ to $10^{-10}$ $(ohm/cm)^{-1}$.

The toner particles of the present invention containing the conductive carbon black embedded therein are magnetically manageable, have adequate flow properties thus enabling these particles to be dispensed consistently from a toner dispenser, have sufficient conductivity to allow adequate developability of electrostatic images, especially electrostatic images of 100 volts; and the mixture is suitably colored, usually black in order to allow the production of crisp dense images.

Insofar as the fusing characteristics the toner composition of the present invention has a low melt rheology, will not block, has excellent dielectric paper surface wetting characteristics, and such compositions do not produce electrographic paper damage. It is believed that the polyester resin impart a low melt characteristic to the resulting mixture, and the magnetic component renders the toner black in color, and magnetically manageable. The carbon black and heat spheroidization step provides for the specific toner conductivity, and in addition enhances free powder flow of the toner at levels which have minimum effect on polymer rheology.

The conductive toners of the present invention can be prepared by various known methods, such as melt blending with heated rolls followed by mechanical attrition, and heat spheroidization (U.S. Pat. No. 3,639,245, the disclosure of which is incorporated herein by reference). Also known spray drying processes can be employed for preparing the toner of this invention. Subsequent to spray drying the toner is subjected to heat spheroidization as indicated herein. In one spray drying method the polyester resin is dissolved in an organic solvent, or solvent mixture, like hexane-chloroform. The magnetic materials is also added to the solvent. Vigorous agitation such as that obtained by ball milling processes assists in insuring good dispersion of the magnetic material. This solution is then pumped through an atomizing nozzle, while using an inert gas such as nitrogen as the atomizing agent. The solvent evaporates during atomization, resulting in toner particles, which are subjected to heat spheroidization with the conductive carbon black as described herein. Particle size of the resulting toner varies depending on the size of the nozzle, however, particles of a diameter between about 0.1 microns and about 100 microns are generally obtained.

As indicated herein the toners of the present invention are useful in printing and recording systems, such as electrostatic Plotters and Printers commercially available from Versatec. In one type of Versatec printing machine programmed voltage is applied to an array of densely spaced writing nibs embedded in a stationary writing head. Upon digital commands the nibs selectively create electrostatic dots (a total of about 2112 dots across a 10.56 inch paper width) on an electrographic paper web passing over a writing head. The print speed is typically about 1,000 lines per minute, and a typical paper speed for this machine is 1 inch per second.

In one method of operation, electrostatic image voltage pulses are applied to the nib, and the back electrode. The electrographic paper is positioned between the nib and the electrode above certain threshold potentials, about 400 volts, air ionization occurs in a small air gap and charge migrates to the electrographic paper, such charge transfer being a function of the voltage, effective air gap, and the electrographic paper characteristics. It is this transferred charge which is developed with the single component conductive magnetic toner of the present invention.

The conductivity of the single component magnetic toner composition of the present invention was measured in a simple dynamic cell conductivity device containing a conductive rotating roll with stationary magnets contained therein. A conductive plate is spaced above the roll at a suitable gap (g), about 1 millimeter. Magnetic toner contained in a small sump is picked up by the magnets, transported with the rotating roll, trimmed to the gap spacing, causing the toner under dynamic conditions to fill the gap, and contact the plate over a zone width (w) equal to 1 centimeter. With the roll turning, typical development conditions are simulated. There is applied to the roll a variable voltage source, which source can be electrically connected to the roll, and current flow to the conductive upper plate is recorded. The results are then recorded on a logrithmic graph, Log I being the Y axis. For conductive toner composition, the current is usually non-ohmic, increasing sharpley with applied field.

The conductivity of the toner composition can be computed at any electrical field from the equation:

$$a = \frac{j}{E} - \frac{I/A}{v/g} - \frac{I/ew}{v/g}$$

wherein:

a=Toner conductivity
E=Electric field
j=Current density
v=Applied voltage
g=Gap spacing-(1 mm)
I=Current
A=Area=1 w
1=device length=8 cm
w=zone width=1 cm The invention will now be described in detail with respect to specific preferred embodiment thereof, it being understood that these examples are intended to be illustrate only and the invention is not intended to be limited to materials, conditions, process parameters and the like recited herein. Parts and percentages are by weight unless otherwise indicated.

EXAMPLE I

There was prepared by melt blending followed by mechanical attrition a toner containing the polyester which is the reaction product of 2,2-bis(4-hydroxy isopropoxy phenyl)propane and fumaric acid, which polyester is commercially available from ICI Corporation, 49 parts by weight and 49 parts per weight of Mapico black. Subsequently there is added to the mixture 2 parts by weight of Vulcan carbon black commercially available from Cities Services; and the mixture is subjected to heat spheroidization at a temperature of 530° C. The heat spheroidization causes the Vulcan carbon black particles to become embedded and permanently attached to the toner particle surface.

There thus resulted a single component conductive magnetic toner, having a conductivity of $8\times10^{-7}$ $(ohm/cm)^{-1}$, which when employed as a developing material in printing and plotting devices, commercially available from Versatec, produced developed images of high quality and excellent resolution. Complete fusing of the image was accomplished at 108° C. with no deterioration of toner, no paper damage, nor any adverse effects on the resulting image. Fusing at such low temperatures (95° C.-130° C.) is very desirable especially since the machine components are less likely to be damaged, and less energy is needed.

The procedure of Example I was repeated with the exception that the Vulcan carbon black and polyester-Mapico black toner mixture was not heat spheroidized, resulting in a toner material that did not contain the carbon black embedded in the toner surface, which toner had a conductivity of $10^{-10}$ $(ohm/cm)^{-1}$. When this toner composition was used to develop images in a Versatec Printing device, there was produced images with very high background. Further the resulting image would not fuse adequately at a temperature of from 90° C. to 125° C.

EXAMPLE II

The procedure of Example I was repeated with the exception that 39 parts by eight of the polyester resin, and 59 parts by weight of Mapico black, are utilized. There resulted a single component conductive magnetic toner having a conductivity of $7\times10^{-7}$ $(ohm/cm)^{-1}$, that completely fused at a temperature of 120° C. When the toner of this Example was selected as a developing material printing and plotting devices commercially available from Versatec, there resulted developed images of high quality and excellent resolution.

EXAMPLE III

The procedure of Example I was repeated with the exception that 48 parts by weight of polyester resin, 48 parts by weight of the Magnetite MO-4232 and 4 parts by weight of Vulcan carbon black were utilized. Substantially similar results were obtained as in Example I, when the toner of this Example was used to develop images in printing and plotting devices.

This toner had a fusing temperature of 117° C.

EXAMPLE IV

The procedure of Example I was repeated with the exception that 4 parts by weight of the Vulcan carbon black was used in place of the 2 parts by weight of Vulcan carbon black. Substantially similar results were obtained as in Example I, when the toner of this Example IV, was used to develop images in printing and plotting devices.

EXAMPLE V

The procedure of Example I was repeated with the exception that 2 parts by weight of Regal 330 carbon black was used in place of the 2 parts by weight of Vulcan carbon black. Substantially similar results were obtained as in Example I, when the toner of this Example, Example V, was used to develop images in printing and plotting devices.

This toner had a fusing temperature of 120° C.

Other modifications of the present invention will occur to those skilled in the art upon a reading of the present disclosure. There are intended to be included within the scope of this invention.

I claim:

1. A process for developing images in electronic printing systems which process consists of forming an electronic image in an electronic printing device, followed by developing the image with a conductive single component magnetic dry toner composition of a conductivity of from $10^{-6}$ to $10^{-8}$ $(ohms/cm)^{-1}$, and a fusing temperature of from about 95 degrees Centigrade to about 130 degrees Centigrade, comprises of a magnetic material present in an amount of from about 40 percent by weight to about 80 percent by weight, and from about 20 percent by weight to about 60 percent by weight of a polyester resin, comprised of the polymeric esterification product of a dicarboxylic acid and a diol comprising a diphenol of the formula:

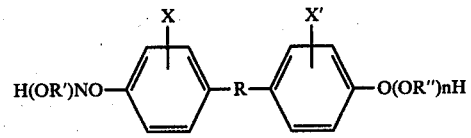

wherein R is selected from substituted and unsubstituted alkylene radicals containing from about 2 to about 12 carbon atoms, alkylidene radicals containing from 1 to about 12 carbon atoms, and cycloclkylidene radicals containing from about 3 to about 12 carbon atoms; R' and R'' are selected from substituted and unsubstituted alkylene radicals containing from about 2 to about 12 carbon atoms, alkylene arylene radicals containing from about 8 to about 12 carbon atoms and arylene radicals; X and X′ are selected from hydrogen or alkyl radicals containing from 1 to about 4 carbon atoms; and each n is a number of from 0 (zero) to 4, and a conductive carbon black present in an amount of from about 0.5 percent to about 4 percent, which carbon black is adhered to or embedded in the surface of the polyester magnetic mixture.

2. A process in accordance with claim 1, wherein the polyester is the reaction product of 2,2-bis(4-hydroxy isopropoxy phenyl)propane and fumaric acid, and the magnetic material is a mixture of iron oxides.

3. A process in accordance with claim 1, wherein the conductive carbon black is embedded in the polyester resin magnetic material mixture by heat spheroidization.

* * * * *